US009574471B2

(12) United States Patent
Hayama

(10) Patent No.: US 9,574,471 B2
(45) Date of Patent: Feb. 21, 2017

(54) EXHAUST MUFFLER

(71) Applicant: HONDA MOTOR CO., LTD., Tokyo (JP)

(72) Inventor: Yoshitaka Hayama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/007,511

(22) Filed: Jan. 27, 2016

(65) Prior Publication Data

US 2016/0222848 A1 Aug. 4, 2016

(30) Foreign Application Priority Data

Jan. 30, 2015 (JP) ..... 2015-017423

(51) Int. Cl.
*F01N 1/16* (2006.01)
*F01N 1/02* (2006.01)
*F01N 1/08* (2006.01)

(52) U.S. Cl.
CPC ..... *F01N 1/166* (2013.01); *F01N 1/02* (2013.01); *F01N 1/08* (2013.01)

(58) Field of Classification Search
CPC ..... F01N 1/165
USPC ..... 181/228, 227, 237, 254
See application file for complete search history.

(56) References Cited

U.S. PATENT DOCUMENTS 6,598,390 B2 * 7/2003 Chang ..... F01N 1/006 181/227
7,527,126 B2 * 5/2009 Kuroda ..... B01D 53/9454 181/254
7,703,574 B2 * 4/2010 Kruger ..... F01N 13/02 181/253
8,397,863 B2 * 3/2013 Paze' ..... F01N 1/166 165/138
8,469,142 B2 * 6/2013 Feng ..... F01N 1/085 181/254
2006/0027420 A1 * 2/2006 Hahnl ..... F01N 1/165 181/283
2006/0162995 A1 * 7/2006 Schorn ..... F01N 1/006 181/237
2007/0227807 A1 * 10/2007 Meneely ..... F01N 1/02 181/237

(Continued)

FOREIGN PATENT DOCUMENTS

JP 10-77822 A 3/1998

*Primary Examiner* — Forrest M Phillips
(74) *Attorney, Agent, or Firm* — Westerman, Hattori, Daniels & Adrian, LLP

(57) ABSTRACT

An exhaust muffler has downstream and upstream chambers which are defined in a casing. Exhaust gas from an internal combustion engine is introduced into an end of a first conduit having a pierced region which is held in fluid communication with the downstream chamber and an end of a second conduit. The other ends of the first and second conduits are open into the upstream chamber. A valve means configured to open/close the first and second conduits is actuated by valve actuating means to switch between a short channel mode discharging the exhaust gas from at least the first conduit through the pierced region, the downstream chamber, and a discharge pipe out of the casing and a long channel mode discharging the exhaust gas from at least the second conduit through the upstream chamber, the pierced region, the downstream chamber, and the discharge pipe out of the casing.

19 Claims, 5 Drawing Sheets

(56) References Cited

U.S. PATENT DOCUMENTS

| | | | | |
|---|---|---|---|---|
| 2008/0078613 | A1* | 4/2008 | Liu | F01N 1/16 181/237 |
| 2011/0083924 | A1* | 4/2011 | Park | F01N 1/04 181/227 |
| 2012/0273302 | A1* | 11/2012 | Takagaki | F01N 1/02 181/228 |
| 2014/0166394 | A1* | 6/2014 | Winkel | F01N 13/107 181/228 |

* cited by examiner

EXHAUST MUFFLER

FIELD OF THE INVENTION

This application relates to an exhaust muffler whose sound silencing characteristics are made variable by causing a change in the flow channel of an exhaust gas from an internal combustion engine.

BACKGROUND OF THE INVENTION

One example of an exhaust muffler is disclosed in Japanese Patent Laid-Open No. Hei 10-77822 ("JP '822") wherein an upstream chamber and a downstream chamber that are held in fluid communication with each other are defined in a casing, and a conduit has a downstream end open into the upstream chamber and a pierced region including a plurality of fluid communication holes held in fluid communication with the downstream chamber that is joined to an exhaust pipe, whereby a flow channel in the casing is made variable by opening and closing the downstream end of the conduit with a valve.

SUMMARY OF THE INVENTION

According to the exhaust muffler disclosed in JP '822, the valve is disposed downstream of the pierced region with respect to the direction in which an exhaust gas flows through the conduit. Although the exhaust gas flows into the pierced region or the downstream chamber when the valve is closed, it is difficult to control a change caused in the amount of exhaust gas flowing from the pierced region into the downstream chamber by the exhaust gas pressure, making it difficult to adjust the sound.

One objective of the present invention is to provide an exhaust muffler which is capable of adjusting the sound well.

In order to achieve the above object, there is provided in accordance with a first aspect of the present invention an exhaust muffler whose sound silencing characteristics are made variable by causing a change in a flow channel of an exhaust gas from an internal combustion engine, including a casing in which an upstream chamber and a downstream chamber are defined with a partition interposed therebetween, a discharge pipe discharging an exhaust gas in the downstream chamber out of the casing, a first conduit having one end into which the exhaust gas from the internal combustion engine is introduced and extending through the partition with an other end thereof being open into the upstream chamber, the first conduit having a pierced region including a plurality of fluid communication holes held in fluid communication with the downstream chamber, a second conduit having one end into which the exhaust gas from the internal combustion engine is introduced and extending through the partition with an other end thereof being open into the upstream chamber, valve means capable of opening and closing the first conduit upstream of the pierced region and also capable of opening and closing the second conduit, and valve actuating means actuating the valve means to switch open and closed states of the first and second conduits to cause a change in the flow channel of the exhaust gas in the casing, wherein the valve actuating means actuates the valve means to switch between a short channel mode discharging the exhaust gas from the internal combustion engine from at least the first conduit through the pierced region, the downstream chamber, and the discharge pipe out of the casing and a long channel mode discharging the exhaust gas from the internal combustion engine from the second conduit through the upstream chamber, the pierced region, the downstream chamber, and the discharge pipe out of the casing. Accordingly, the first conduit can be closed upstream of the pierced region, so that the channel through which the exhaust gas reaches the pierced region can change between the short channel mode and the long channel mode, for thereby making good sound adjustments.

According to a second aspect of the present invention, in addition to the arrangement of the first aspect, the valve actuating means actuates the valve means to close the second conduit and open the first conduit in the short channel mode. Accordingly, in the short channel mode with the first conduit being open, the second conduit is closed thereby to use the upstream chamber leading into the first conduit and the interior of the second conduit as a large-capacity resonator chamber. Though the exhaust muffler is unable to obtain a large sound silencing effect, it can silence sounds in a sound range to be silenced. According to a third aspect of the present invention, in addition to the arrangement of the first or second aspects, the valve means has a first valve disposed in the first conduit upstream of the pierced region and a second valve disposed in the second conduit, the first and second valves coupled in an interlinked fashion such that when one of the valves is opened, the other valve is closed. Accordingly, as the first and second valves which make up the valve means operate in an interlinked fashion, the valve actuating means can be of a simple structure having a single actuator. According to a fourth aspect of the present invention, in addition to the arrangement of the third aspect, the first and second conduits are disposed adjacent and parallel to each other, and the first and second valves are mounted on a valve shaft which is angularly movably supported in the first and second conduits. Accordingly, since the first and second conduits are disposed adjacent and parallel to each other and the first valve that is disposed in the first conduit upstream of the pierced region and the second valve disposed in the second conduit are mounted on the common valve shaft, the first and second valves are easily interlinked without a reduction in the capacity of the exhaust muffler, and the volume of a resonator chamber is increased when part of the resonator chamber is provided by the interior of the second conduit in the short channel mode with the second valve being closed.

According to a fifth aspect of the present invention, in addition to the arrangement of the first or second aspects, the first and second conduits have respective one ends connected commonly to a single exhaust pipe that guides the exhaust gas from the internal combustion engine, and the valve means includes a single valve disposed in a junction between the one ends of the first and second conduits and the exhaust pipe. Accordingly, inasmuch as the valve means includes the single valve, the number of parts used is reduced in switching the opening and closing of the first and second conduits. According to a sixth aspect of the present invention, in addition to the arrangement of any one of the first through fifth aspects, a wall defining the downstream chamber between itself and the partition is provided in the casing, and the pierced region is defined in the first conduit at a position closer to the wall than the partition. Accordingly, the pierced region is defined in the first conduit at a position where the distance between the pierced region and the wall that defines the downstream chamber between itself and the partition is smaller than the distance between the pierced region and the partition. Consequently, the first conduit is used over a shorter distance in the short channel mode, and is used over a longer distance in the long channel mode, thereby increasing the difference between sound silencing characteristics.

According to a seventh aspect of the present invention, in addition to the arrangement of any one of the first through sixth aspects, the pierced region and the discharge pipe have respective relative positions established to cause the exhaust gas to flow back two or more times in the casing in the long channel mode. Accordingly, since the exhaust gas is caused to flow back two or more times in the casing in the long channel mode, the speed at which the exhaust gas flows is reduced for a higher sound silencing effect.

DETAILED DESCRIPTION OF THE INVENTION

Embodiments of the present invention will be described below with reference to the accompanying drawings. In the description that follows, front, rear, left, right, above, below, and other similar directional terms represent directions as viewed by an occupant on a motorcycle.

Figure 1:
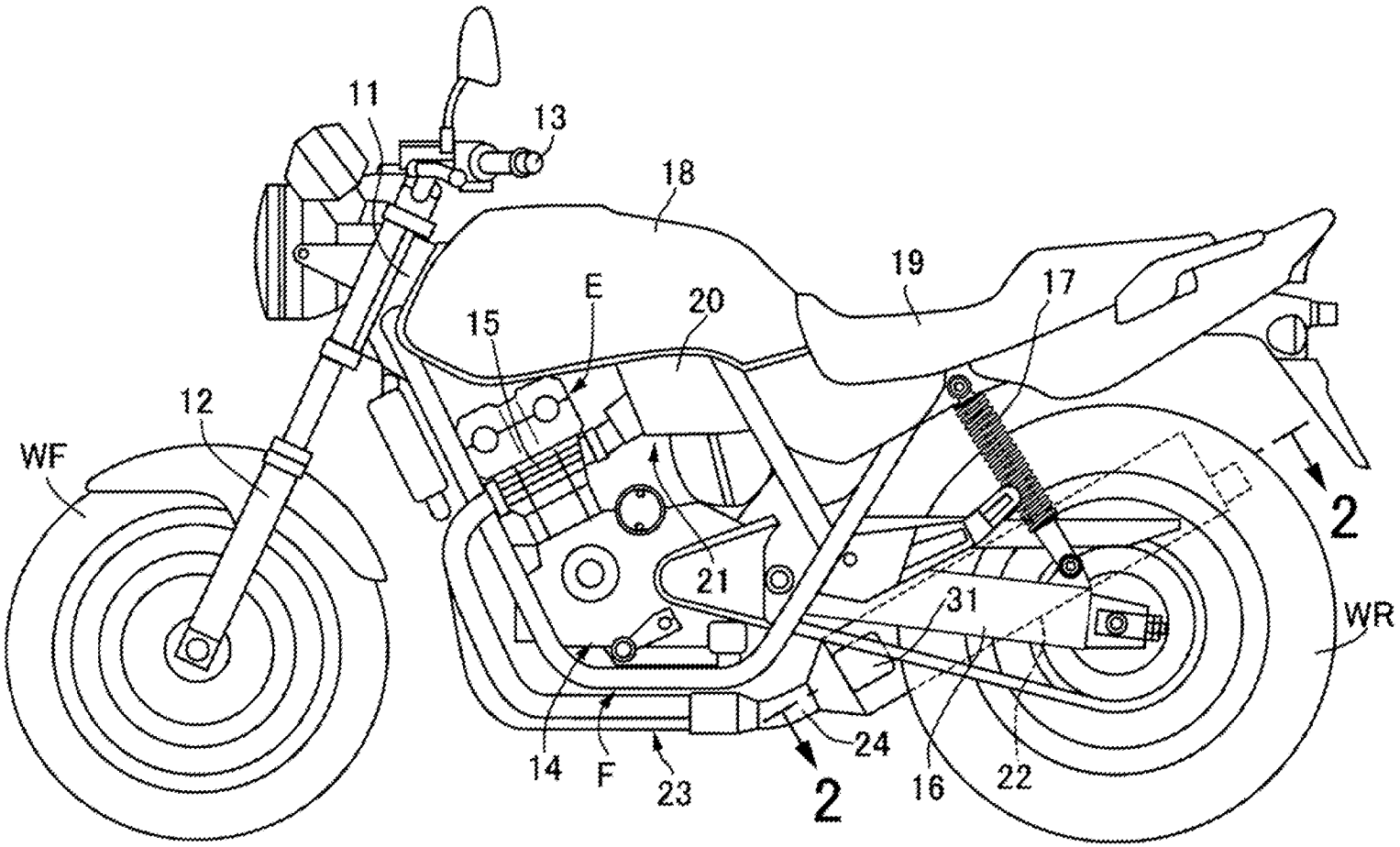
FIG. 1 is a side elevational view of a motorcycle according to a first embodiment of the present invention.

A first embodiment of the present invention will be described below with reference to FIGS. 1 through 3. As shown in FIG. 1, a front fork 12 on which a front wheel WF is supported by a shaft and a steering handle 13 joined to the front fork 12 are steerably supported on a head pipe 11 that is provided on the front end of a vehicle body frame F of a motorcycle. An internal combustion engine E for generating power for driving a rear wheel WR includes an engine body 14 mounted on the vehicle body frame F between the front wheel WF and the rear wheel WR. The rear wheel WR is supported by a shaft on the rear end of a swing arm 16. The front end of the swing arm 16 is swingably supported on the vehicle body frame F behind the engine body 14. A rear cushion unit 17 is provided between a rear portion of the vehicle body frame F and the swing arm 16.

The vehicle body frame F supports thereon a fuel tank 18 disposed above the engine body 14 and a tandem-type occupant seat 19 disposed behind the fuel tank 18.

The engine body 14 includes, as part thereof, a cylinder head 15 having a rear side wall connected to an intake system 21 having an air cleaner 20 that is disposed rearwardly and downwardly of the fuel tank 18. The cylinder head 15 also has a front side wall connected to an exhaust system 23 having an exhaust muffler 22 that is disposed on a right-hand side of the rear wheel WR.

Figure 2:
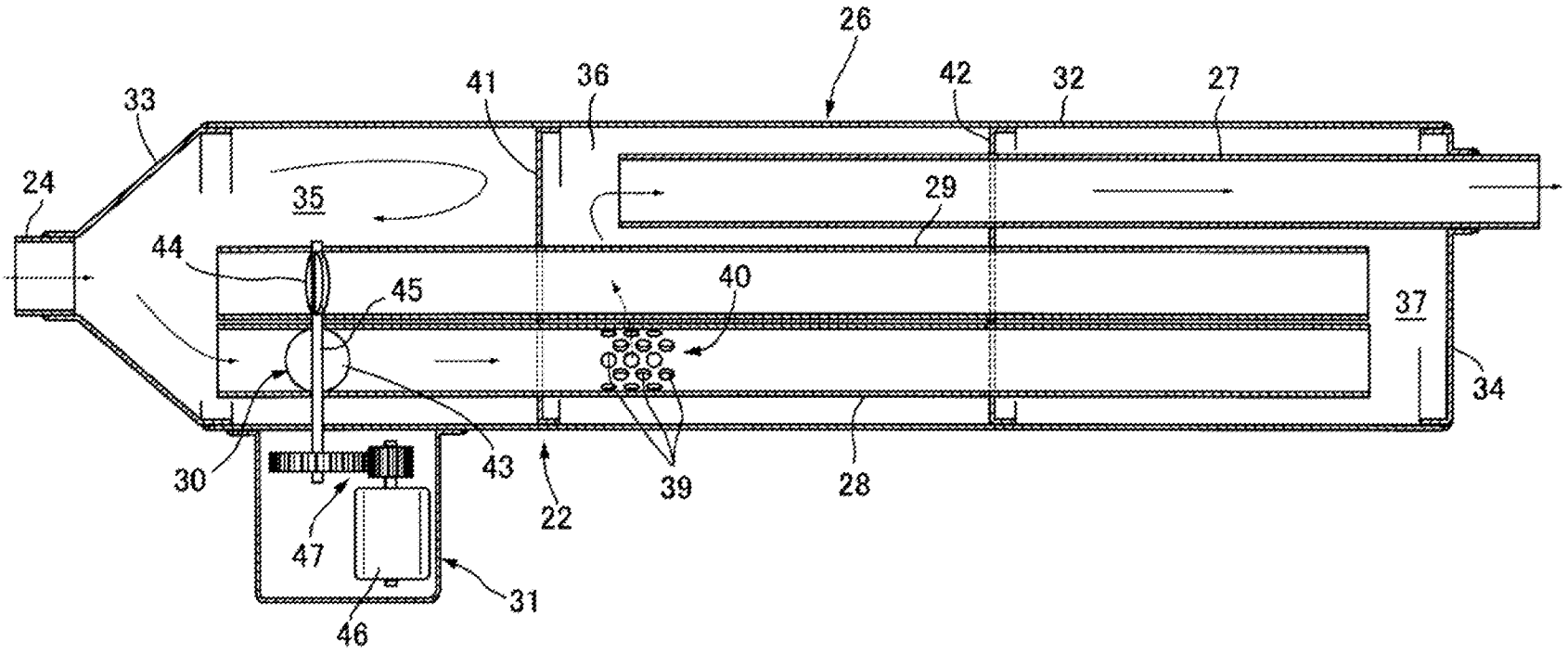
FIG. 2 is a cross-sectional view taken along line 2-2 of FIG. 1, showing an exhaust muffler in a short channel mode.
Figure 3:
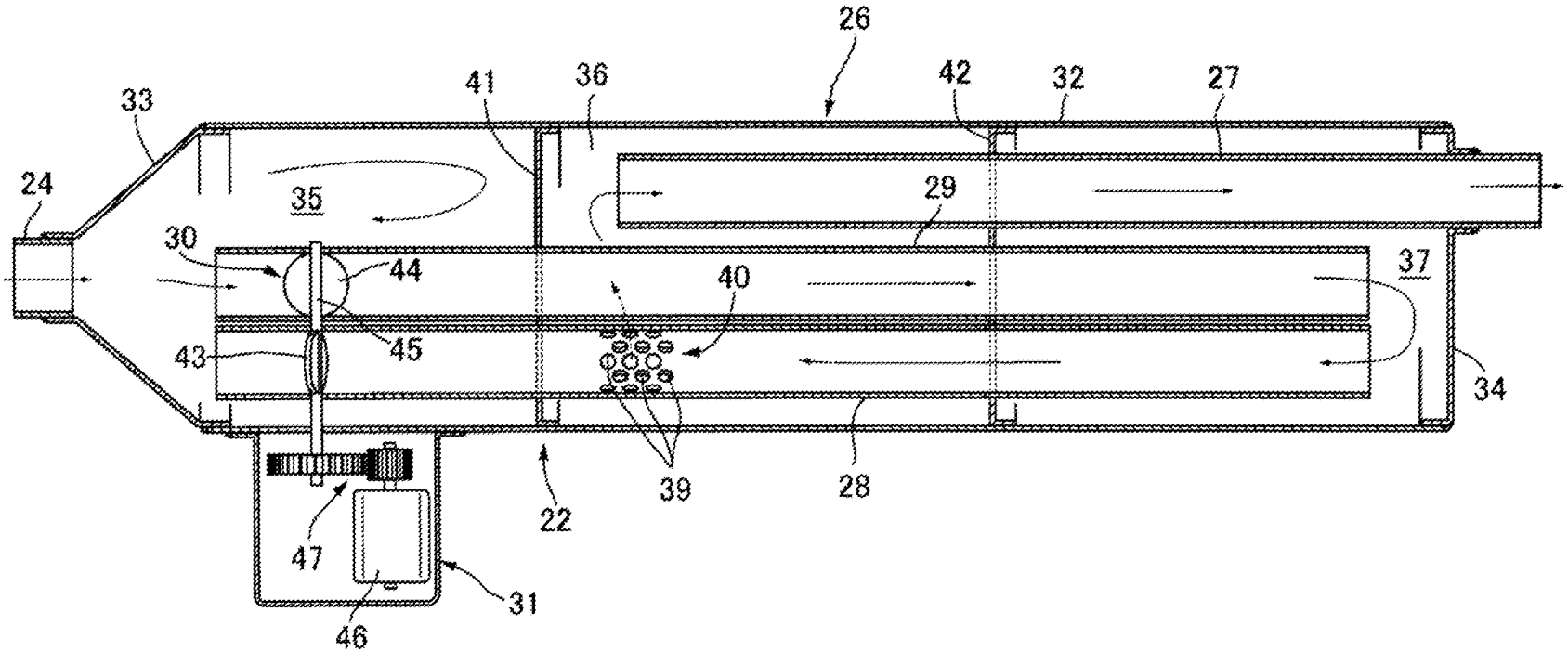
FIG. 3 is a cross-sectional view similar to FIG. 2, showing the exhaust muffler in a long channel mode.

As shown in FIG. 2, the exhaust muffler 23, which is configured to and capable of changing its sound silencing characteristics by causing a change in the flow channel of an exhaust gas from the internal combustion engine E, includes a casing 26, a discharge pipe 27 for discharging the exhaust gas in a downstream chamber 36 in the casing 26 out of the casing 26, a first conduit 28 having an end into which the exhaust gas from the internal combustion engine E is introduced and a pierced region 40 including a plurality of fluid communication holes 39 held in fluid communication with the downstream chamber 36, a second conduit 29 having an end into which the exhaust gas from the internal combustion engine E is introduced, valve means 30 for opening and closing the first conduit 28 upstream of the pierced region 40 and also for opening and closing the second conduit 29, and valve actuating means 31 for actuating the valve means 30 to switch the open and closed states of the first and second conduits 28 and 29 to cause a change in the flow channel of the exhaust gas in the casing 26.

The casing 26 includes an elongate tubular main casing body 32 extending along the longitudinal directions of the vehicle, a front end wall 33 coupled to the front end of the main casing body 32, and a rear end wall 34 closing the rear end of the main casing body 32. The front end wall 33 is of a tapered shape that is progressively smaller in diameter toward the front.

The casing 26 defines therein an exhaust gas introduction chamber 35, the downstream chamber 36, and an upstream chamber 37 arranged in the order named from the front. The exhaust gas introduction chamber 35 is defined between a first partition 41 whose outer circumferential portion is fixed to the main casing body 32 at a position spaced rearwardly from the front end wall 33, and the front end wall 33. The downstream chamber 36 is defined between a second partition 42 whose outer circumferential portion is fixed to the main casing body 32 at a position spaced rearwardly from the first partition 41, and the first partition 41. The upstream chamber 37 is defined between the second partition 42 and the rear end wall 34.

To the center of the front end wall 33, there is connected an exhaust pipe 24 for guiding the exhaust gas from the internal combustion engine E. The discharge pipe 27 extends as an elongate pipe along the longitudinal directions of the main casing body 32. The discharge pipe 27 has an end open into the downstream chamber 36, extends through the second partition 42 and the rear end wall 34, and has the other end open outwardly outside of the casing 26.

The first and second conduits 28 and 29 extend adjacent and parallel to each other along the longitudinal directions of the discharge pipe 27 and through the first and second partitions 41 and 42. The first and second conduits 28 and 29 have respective one ends open into the exhaust gas introduction chamber 35 for introducing the exhaust gas guided from the exhaust pipe 24 into the exhaust gas introduction chamber 35. The other ends of the first and second conduits 28 and 29 are open into the upstream chamber 37.

The first partition 41 is a wall provided in the casing 26 so as to define the downstream chamber 36 between itself and the second partition 42. The pierced region 40 is defined in the first conduit 28 at a position closer to the first partition 41 as the wall than the second partition 42.

The valve means 30 has a first valve 43 disposed in the first conduit 28 upstream of the pierced region 40 and a second valve 44 disposed in the second conduit 29. The first and second valves 43 and 44 are coupled in an interlinked fashion such that when one of the valves 43 and 44 is opened, the other is closed. The first and second valves 43 and 44, each in the form of a butterfly valve, are mounted on a valve shaft 45 which is angularly movably supported in the portions of the first and second conduits 28 and 29 disposed parallel to each other which are housed in the exhaust gas introduction chamber 35.

The valve shaft 45 extends angularly movably through the main casing body 32 of the casing 26. The valve actuating means 31 has an electric motor 46 serving as an actuator for generating power to angularly move the valve shaft 45 about its own axis and a speed reducer mechanism 47 disposed between the valve shaft 45 and the electric motor 46. As shown in FIG. 1, the valve actuating means 31 is mounted on a left side surface of the casing 26 disposed on the right side of the rear wheel WR, in front of the rear wheel WR.

The valve actuating means 31 actuates the valve means 30 to switch between a short channel mode for discharging the exhaust gas from the internal combustion engine E from at least the first conduit 28 through the pierced region 40, the downstream chamber 36, and the discharge pipe 27 out of the casing 26 and a long channel mode for discharging the exhaust gas from the internal combustion engine E from the second conduit 29 through the upstream chamber 37, the pierced region 40, the downstream chamber 36, and the discharge pipe 27 out of the casing 26. In the short channel mode, as shown in FIG. 2, the valve actuating means 31 opens the first valve 43 to open the first conduit 28 and closes the second valve 44 to close the second conduit 29. In the long channel mode, as shown in FIG. 3, the valve actuating means 31 closes the first valve 43 to close the first conduit 28 and opens the second valve 44 to open the second conduit 29.

The pierced region 40 and the discharge pipe 27 have respective relative positions established to cause the exhaust gas to flow back two or more times in the casing 26 in the long channel mode. The end of the discharge pipe 27 that is open into the downstream chamber 36 is disposed in a position corresponding to the pierced region 40 along the longitudinal directions of the discharge pipe 27 and the first conduit 28.

Operation of the first embodiment will be described below. The exhaust muffler 22 includes the casing 26 in which the upstream chamber 37 and the downstream chamber 36 are defined with the second partition 42 interposed therebetween, the discharge pipe 27 for discharging the exhaust gas in the downstream chamber 36 out of the casing 26, the first conduit 28 having one end into which the exhaust gas from the internal combustion engine E is introduced and extending through the second partition 42 with the other end thereof being open into the upstream chamber 37, the first conduit 28 having the pierced region 40 including the fluid communication holes 39 held in fluid communication with the downstream chamber 36, the second conduit 29 having one end into which the exhaust gas from the internal combustion engine E is introduced and extending through the second partition 42 with the other end thereof being open into the upstream chamber 37, the valve means 30 for opening and closing the first conduit 28 upstream of the pierced region 40 and also for opening and closing the second conduit 29, and the valve actuating means 31 for actuating the valve means 30 to switch the open and closed states of the first and second conduits 28 and 29 to cause a change in the flow channel of the exhaust gas in the casing 26. The valve actuating means 31 actuates the valve means 30 to switch between the short channel mode for discharging the exhaust gas from the internal combustion engine E from at least the first conduit 28 through the pierced region 40, the downstream chamber 36, and the discharge pipe 27 out of the casing 26 and the long channel mode for discharging the exhaust gas from the internal combustion engine E from the second conduit 29 through the upstream chamber 37, the pierced region 40, the downstream chamber 36, and the discharge pipe 27 out of the casing 26. The first conduit 28 can be closed upstream of the pierced region 40, so that the channel through which the exhaust gas reaches the pierced region 40 can change between the short channel mode and the long channel mode, for thereby making good sound adjustments.

The valve actuating means 31 actuates the valve means 30 to close the second conduit 29 and open the first conduit 28 in the short channel mode. Therefore, in the short channel mode with the first conduit 28 being open, the second conduit 29 is closed thereby to use the upstream chamber 37 leading into the first conduit 28 and the interior of the second conduit 29 as a large-capacity resonator chamber. Though the exhaust muffler 22 is unable to obtain a high sound silencing effect, it can silence sounds in a sound range to be silenced.

The valve means 30 has the first valve 43 disposed in the first conduit 28 upstream of the pierced region 40 and the second valve 44 disposed in the second conduit 29. The first and second valves 43 and 44 are coupled in an interlinked fashion such that when one of the valves 43 and 44 is opened, the other is closed. Therefore, the valve actuating means 31 can be of a simple structure having the single electric motor 46.

Since the first and second conduits 28 and 29 are disposed adjacent and parallel to each other and the first and second valves 43 and 44 are mounted on the valve shaft 45 that is angularly movably supported in the first and second conduits 28 and 29, the first and second valves 43 and 44 are easily interlinked without a reduction in the capacity of the exhaust muffler 22, and the volume of a resonator chamber is increased when part of the resonator chamber is provided by the interior of the second conduit 29 in the short channel mode with the second valve 44 being closed.

The first partition 41 which defines the downstream chamber 36 between itself and the second partition 42 is disposed in the casing 26, and the pierced region 40 is defined in the first conduit 28 at a position closer to the first partition 41 than the second partition 42. Consequently, the first conduit 28 is used over a shorter distance in the short channel mode, and is used over a longer distance in the long channel mode, thereby increasing the difference between sound silencing characteristics.

Furthermore, since the relative positions of the pierced region 40 and the discharge pipe 27 are established to cause the exhaust gas to flow back two or more times in the casing 26 in the long channel mode, the exhaust gas flows back two or more times in the casing 26 in the long channel mode, so that the speed at which the exhaust gas flows is reduced for a higher sound silencing effect.

Figure 4:
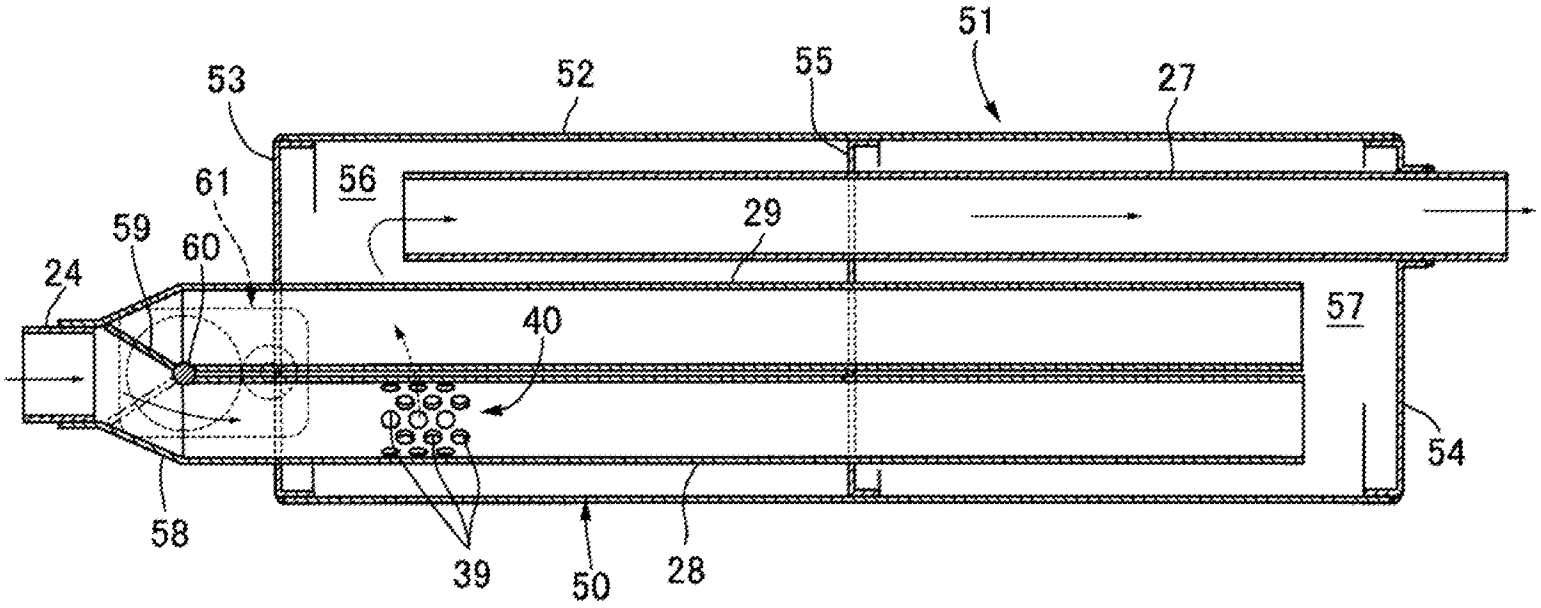
FIG. 4 is a cross-sectional view similar to FIG. 2, showing an exhaust muffler according to a second embodiment of the present invention in a short channel mode.
Figure 5:
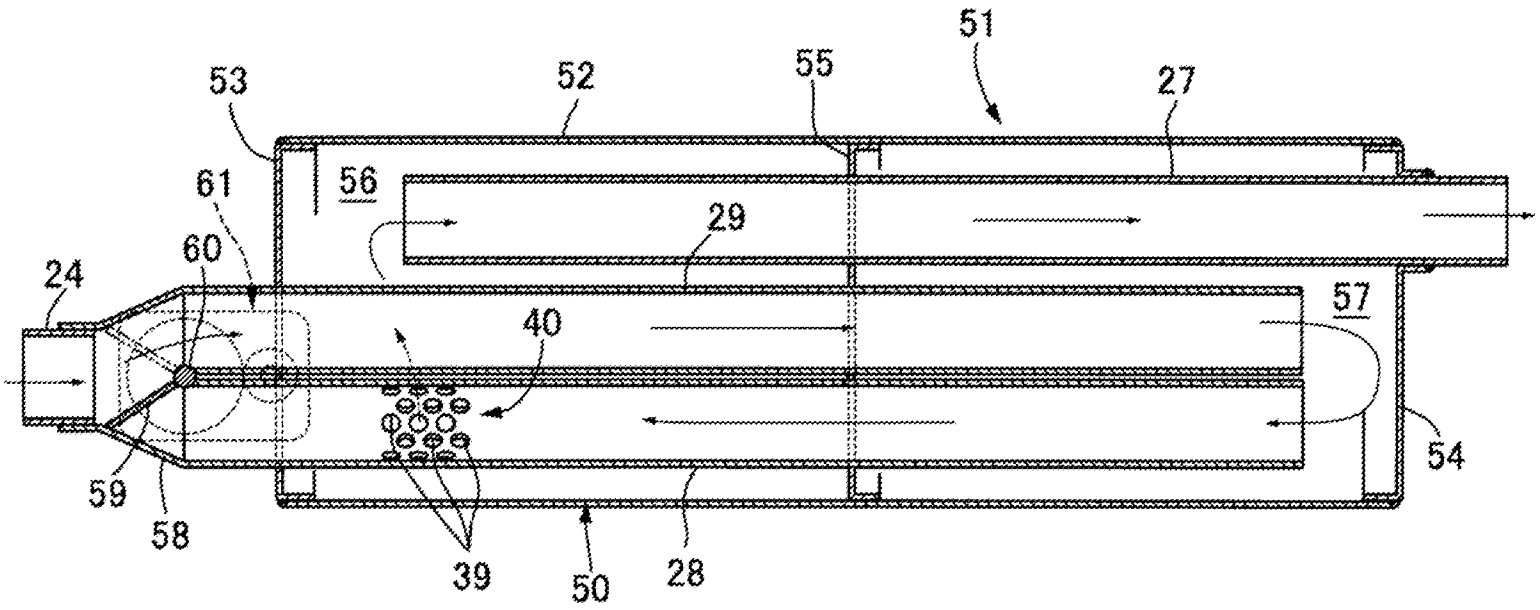
FIG. 5 is a cross-sectional view similar to FIG. 4, showing the exhaust muffler according to the second embodiment in a long channel mode.

A second embodiment of the present invention will be described below with reference to FIGS. 4 and 5. Those parts of the second embodiment which correspond to those of the first embodiment will be denoted by identical reference characters and will only be illustrated.

An exhaust muffler 50 has a casing 51 including an elongate tubular main casing body 52 extending along the longitudinal directions of the vehicle, a front end wall 53 coupled to the front end of the main casing body 52, and a rear end wall 54 closing the rear end of the main casing body 52.

The casing 51 has a downstream chamber 56 and an upstream chamber 57 that are defined therein in the order named successively from the front thereof. The downstream chamber 56 is defined between a partition 55 whose outer circumferential portion is fixed to the main casing body 52 at a longitudinally intermediate portion thereof and the front end wall 53. The upstream chamber 57 is defined between the partition 55 and the rear end wall 54.

A discharge pipe 27 for discharging the exhaust gas in the downstream chamber 56 out of the casing 51 extends as an elongate pipe along the longitudinal directions of the main casing body 52. The discharge pipe 27 has an end open into the downstream chamber 56, extends through the partition 55 and the rear end wall 54, and has the other end open outwardly outside of the casing 51.

The first conduit 28 that has a pierced region 40 including a plurality of fluid communication holes 39 held in fluid communication with the downstream chamber 56 and a second conduit 29 is disposed in the casing 51 such that it extends adjacent and parallel to each other along the longitudinal directions of the discharge pipe 27 and through the front end wall 53 and the partition 55.

The front end wall 53 is a wall provided in the casing 51 so as to define the downstream chamber 56 between itself and the partition 55. The pierced region 40 is defined in the first conduit 28 at a position closer to the front end wall 53 than the partition 55.

The first and second conduits 28 and 29 have respective one ends into which the exhaust gas from the exhaust pipe 24 is introduced and respective other ends that are open into the upstream chamber 57.

The one ends of the first and second conduits 28 and 29 are connected by a joint pipe 58 commonly to the single exhaust pipe 24 that guides the exhaust gas from the internal combustion engine E (see the first embodiment). A single valve 59 that serves as valve means is disposed in the joint pipe 58 as a junction between the one ends of the first and second conduits 28 and 29 and the exhaust pipe 24.

The valve 59 is mounted on a valve shaft 60 angularly movably supported in the joint pipe 58. The valve shaft 60 is coupled to valve actuating means 61.

The valve actuating means 61 angularly moves the valve shaft 60 to switch between a short channel mode for discharging the exhaust gas from the internal combustion engine E from the first conduit 28 through the pierced region 40, the downstream chamber 56, and the discharge pipe 27 out of the casing 51 and a long channel mode for discharging the exhaust gas from the internal combustion engine E from the second conduit 29 through the upstream chamber 57, the pierced region 40, the downstream chamber 56, and the discharge pipe 27 out of the casing 51. In the short channel mode, as shown in FIG. 4, the valve 59 operates to open the first conduit 28 and close the second conduit 29. In the long channel mode, as shown in FIG. 5, the valve 59 operates to close the first conduit 28 and open the second conduit 29.

According to the second embodiment, the exhaust muffler 50 offers the same advantages as those of the first embodiment, and the number of parts used is reduced in switching the opening and closing of the first and second conduits 28 and 29.

While the embodiments of the present invention have been described above, the present invention is not limited to the above embodiments, but it is possible to make various changes in design without departing from the invention described in the scope of claims for patent.

I claim:

1. An exhaust muffler whose sound silencing characteristics are made variable by causing a change in a flow channel of an exhaust gas from an internal combustion engine, comprising:

a casing in which an upstream chamber and a downstream chamber are defined with a partition interposed therebetween;

a discharge pipe configured to discharge an exhaust gas in said downstream chamber out of said casing;

a first conduit having one end into which the exhaust gas from the internal combustion engine is introduced and extending through said partition with an other end thereof being open into said upstream chamber, said first conduit having a pierced region including a plurality of fluid communication holes held in fluid communication with said downstream chamber;

a second conduit, different from the first conduit, having one end into which the exhaust gas from the internal combustion engine is introduced and extending through said partition with an other end thereof being open into said upstream chamber;

valve means configured to open and close said first conduit upstream of said pierced region and to open and close said second conduit; and valve actuating means actuating said valve means to switch open and closed states of the first and second conduits to cause a change in the flow channel of the exhaust gas in said casing;

wherein said valve actuating means actuates said valve means to switch between a short channel mode discharging the exhaust gas from said internal combustion engine from at least said first conduit through said pierced region into said downstream chamber, and through said discharge pipe out of the casing and a long channel mode discharging the exhaust gas from said internal combustion engine from said second conduit through said upstream chamber, into said first conduit, through said pierced region into said downstream chamber, and through said discharge pipe out of the casing, and wherein the pierced region is only formed in the first conduit.

2. The exhaust muffler according to claim 1, wherein said valve actuating means actuates said valve means to close said second conduit and open said first conduit in the short channel mode.

3. The exhaust muffler according to claim 1, wherein said valve means has a first valve provided in said first conduit upstream of said pierced region and a second valve provided in said second conduit, the first and second valves coupled in an interlinked manner such that when one of the first and second valves is opened, an other of the first and second valves is closed.

4. The exhaust muffler according to claim 3, wherein the first and second conduits are positioned adjacent and parallel to each other, and the first and second valves are mounted on a valve shaft which is angularly movably supported in the first and second conduits.

5. The exhaust muffler according to claim 1, wherein the first and second conduits have respective one ends connected commonly to a single exhaust pipe that guides the exhaust gas from the internal combustion engine, and said valve means includes a single valve provided in a junction between the one ends of said first conduit and second conduit and said exhaust pipe.

6. The exhaust muffler according to claim 1, wherein a wall defining said downstream chamber between itself and said partition is provided in said casing, and said pierced region is defined in said first conduit at a position closer to said wall than said partition.

7. The exhaust muffler according to claim 1, wherein said pierced region and said discharge pipe have respective relative positions designed to cause said exhaust gas to flow back two or more times in said casing in said long channel mode.

8. The exhaust muffler according to claim 2, wherein said valve means has a first valve provided in said first conduit upstream of said pierced region and a second valve provided in said second conduit, the first and second valves coupled in an interlinked manner such that when one of the first and second valves is opened, an other of the first and second valves is closed.

9. The exhaust muffler according to claim 2, wherein the first and second conduits have respective one ends connected commonly to a single exhaust pipe that guides the exhaust gas from the internal combustion engine, and said valve means includes a single valve provided in a junction between the one ends of said first conduit and second conduit and said exhaust pipe.

10. The exhaust muffler according to claim 2, wherein a wall defining said downstream chamber between itself and said partition is provided in said casing, and said pierced region is defined in said first conduit at a position closer to said wall than said partition.

11. The exhaust muffler according to claim 3, wherein a wall defining said downstream chamber between itself and said partition is provided in said casing, and said pierced region is defined in said first conduit at a position closer to said wall than said partition.

12. The exhaust muffler according to claim 4, wherein a wall defining said downstream chamber between itself and said partition is provided in said casing, and said pierced region is defined in said first conduit at a position closer to said wall than said partition.

13. The exhaust muffler according to claim 5, wherein a wall defining said downstream chamber between itself and said partition is provided in said casing, and said pierced region is defined in said first conduit at a position closer to said wall than said partition.

14. The exhaust muffler according to claim 2, wherein said pierced region and said discharge pipe have respective relative positions designed to cause said exhaust gas to flow back two or more times in said casing in said long channel mode.

15. The exhaust muffler according to claim 3, wherein said pierced region and said discharge pipe have respective relative positions designed to cause said exhaust gas to flow back two or more times in said casing in said long channel mode.

16. The exhaust muffler according to claim 4, wherein said pierced region and said discharge pipe have respective relative positions designed to cause said exhaust gas to flow back two or more times in said casing in said long channel mode.

17. The exhaust muffler according to claim 5, wherein said pierced region and said discharge pipe have respective relative positions designed to cause said exhaust gas to flow back two or more times in said casing in said long channel mode.

18. The exhaust muffler according to claim 6, wherein said pierced region and said discharge pipe have respective relative positions designed to cause said exhaust gas to flow back two or more times in said casing in said long channel mode.

19. The exhaust muffler according to claim 1, wherein the pierced region is only formed in a portion of the first conduit located in the downstream chamber.

* * * * *